United States Patent [19]

Beckmann et al.

[11] Patent Number: 4,496,202

[45] Date of Patent: Jan. 29, 1985

[54] DEVICE FOR HIGH VOLTAGE TRANSFER BETWEEN TWO PARTS WHICH ARE ROTATABLE RELATIVE TO EACH OTHER

[75] Inventors: Friedrich K. Beckmann, Schenefeld; Thomas Helzel, Norderstedt; Horst Peemöller, Hamburg, all of Fed. Rep. of Germany

[73] Assignee: U.S. Philips Corporation, New York, N.Y.

[21] Appl. No.: 502,888

[22] Filed: Jun. 9, 1983

[30] Foreign Application Priority Data

Jun. 9, 1982 [DE] Fed. Rep. of Germany ..... 3221791

[51] Int. Cl.[3] ..... H01R 39/02

[52] U.S. Cl. ..... 339/5 R; 339/8 PB

[58] Field of Search ..... 339/5 R, 8 R, 8 PB

[56] References Cited

U.S. PATENT DOCUMENTS 3,123,421 3/1964 Phillips ..... 339/8 PB
4,335,927 6/1982 Allen et al. ..... 339/5 R

FOREIGN PATENT DOCUMENTS 39994 11/1981 European Pat. Off. .
3010819 9/1981 Fed. Rep. of Germany .
2061028 5/1981 United Kingdom .

*Primary Examiner*—Eugene F. Desmond
*Attorney, Agent, or Firm*—Marc D. Schechter

[57] ABSTRACT

The invention relates to a high voltage transfer device comprising two insulator bodies which are rotatable with respect to each other. In each insulator body there is embedded an electrode arrangement which horizontally encloses the axis of rotation. The two electrode arrangements together form a kind of Faraday cage, so that the field between the two electrode arrangements and in their vicinity is corrected and reduced.

6 Claims, 2 Drawing Figures

DEVICE FOR HIGH VOLTAGE TRANSFER BETWEEN TWO PARTS WHICH ARE ROTATABLE RELATIVE TO EACH OTHER

BACKGROUND OF THE INVENTION

The invention relates to a device for transferring high voltage between two parts which are rotatable relative to each other. Each of the two parts comprises an insulator body. At least one of the parts comprises an electrode arrangement which carries the high voltage. The electrode is concentric with the axis of rotation and is in electrical contact with contact elements. A device of this kind is required, for example, for high voltage transfer in a computer tomography X-ray apparatus.

German Offenlegungsschrift No. 3010819 discloses a high voltage transfer device in which, the rotating part comprises an electrode track. The electrode track is concentric with the axis of rotation contact elements, which are mounted on the stationary part of the device and which are connected to the high voltage generator, slide on the electrode track. In order to increase the creepage path between an electrode arrangement and ground or between electrode arrangements carrying different high voltage potentials, the rotor and the stator comprise engaging ridges which are concentric with the axis of rotation.

The field distribution at the area of the electrode track is substantially inhomogeneous. The maximum of the field occurs directly at the surface of the electrode track, at least a part of which is in contact with air. Consequently, the air is liable to be ionized. This may damage the insulator bodies.

Another high voltage transfer device is described in United Kingdom Patent Application No. 2,061,028. In this device, the space between the rotor and the stator is filled with an electrically insulating liquid, for example oil, which has a substantially higher breakdown voltage than air. However, seals must be provided between the two parts which are rotatable relative to each other in order to prevent leakage of the liquid.

Still another high voltage transfer device is described in European Patent Application No. 39,994. In this device, however, the space between the rotor and the stator is filled with a gas having a substantially higher breakdown voltage than air. The gas may be, for example, sulphur hexafluoride or "Freon". The contact elements are constructed as contact brushes surrounded by a screen which serves to reduce the field strength at the area of the contact brushes.

All known devices have in common a substantially inhomogeneous field distribution at the area of the electrode track, with a maximum field strength at the electrode surface. The contact elements must be shaped so that the field strength does not become excessively high. Wear particles formed during the sliding of the contact elements on the electrode track contaminate the insulator surface in the direct vicinity of the electrode track or the electrode track itself, so that the electric strength of the device is reduced.

SUMMARY OF THE INVENTION

It is an object of the present invention to provide a high voltage transfer device in which the field distribution in the space between the rotor and the stator is more homogeneous and is reduced.

This object is achieved according to the invention in that both insulator bodies are provided with electrodes which enclose the axis of rotation so as to be concentric therewith. A more homogeneous field distribution is thus achieved between the two concentric electrode arrangements as well as in their vicinity, because both arrangements carry the same potential during operation.

The electrode arrays could in principle be flat and be situated in parallel planes. However, in a further embodiment of the invention the cross-section of at least one of the two electrodes corresponds to the shape of a "U" which opens toward the other electrode. The limbs of the "U" terminate at a small distance from the other electrode, so that the facing surfaces of both electrodes bound an annular cavity.

The two electrode arrangements form a Faraday cage for the annular cavity which is situated therebetween and which is, consequently, substantially free of electric fields. The contact elements used in this cavity, therefore, may have an arbitrary shape.

The operation of the device is hardly affected by worn-off particles of the contact elements. Even though the electric field strength may still be comparatively high at the outer surface of the electrode arrangement, the outer surface of the electrode arrangement is embedded in the insulator body whose breakdown voltage is substantially higher than that of air.

In a further version of this preferred embodiment of the invention, the cross-section of the insulator bodies comprises sections on both limbs which are parallel to the symmetry line between the electrode arrangements and which change over into inclined sections on which the distance from the other insulator body is larger than on the end face. Due to this configuration, the field strength in the cavity between the two insulator bodies is reduced to such an extent that ionization of air cannot occur.

DESCRIPTION OF THE PREFERRED EMBODIMENTS

The high voltage transfer device is shaped as a closed ring. The ring consists of an outer ring 1 and an inner ring 2 which are rotatable relative to each other and which are arranged so as to be concentric with the axis of rotation 3. The inner ring 2 is enclosed by the outer ring 1. The outer ring 1 may be the stator and the inner ring 2 may be the rotor. However, these functions may also be interchanged.

Figure 2:
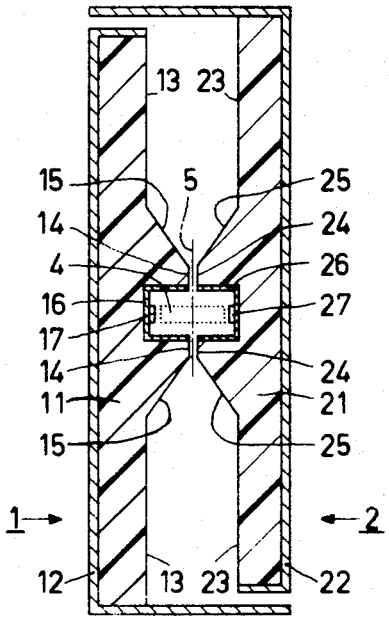
FIG. 2 is an enlarged cross-sectional view of a part of such device.

As shown in FIG. 2, each of the rings 1 and 2 comprises an insulator body 11 and 21, respectively. Each insulator body is enclosed on all sides (except for the surface facing the other ring) by a grounded metal housing 12 and 22, respectively. The nonmetallic surfaces of the annular insulating bodies comprise outer sections 13 and 23, respectively, which extend vertically and in parallel, and central sections 14 and 24, respectively, which also extend vertically and in parallel but at a substantially smaller distance from each other than the outer sections 13 and 23. Between the outer and central sections there are inclined sections 15 and 25, respectively, which have an angle of inclination on the order of magnitude of 21°.

In the two insulating bodies 11 and 21, annular electrode arrangements are provided. The electrodes have an approximately U-shaped cross-section and are embedded at the area of the central sections 14 and 24, respectively. Each of the two electrode arrangements consists of a metallic screen 16 and 26. The metallic screens define the outer boundaries of the electrode arrangement and of an annular electrode tracks 17 and 27, respectively.

The major part of the current flows between the two rotatable parts via the electrode tracks 17 and 27 during operation. To this end, the electrode tracks 17 and 27 are connected to a high voltage generator or to a high voltage appliance (for example an X-ray tube) via high voltage leads (not shown). The high voltage leads are passed through the insulator bodies 11 and 21 (and through the grounded screens 12 and 22).

For the high voltage transfer between tracks 17 and 27, there is provided a roller 4. Roller 4 is the contact element, and it runs on the electrode tracks 17 and 27 in order to establish electrical contact between the two tracks. Disregarding the contact element and the outer shape of the insulator body, the cross-section of the device is symmetrical. The symmetry line is denoted by the reference numeral 5.

The U-shaped cross-sections of the screens 16 and 26 of the two electrode arrangements open toward one another, and their limbs terminate at a small distance from one another, for example from 1 to 2 mm.

The screens 16 and 26, carrying the same potential which is identical to the potential of the electrode track, thus form a Faraday cage whose interior is substantially free from electric fields. Comparatively small electric field strengths occur at the area of the separation between the limbs. Consequently, for the high voltage transfer, the shape of the transfer elements can be arbitrary.

The contact elements may be, inter alia, contact brushes (in that case one of the two electrode tracks may be dispensed with because the contact brush is connected directly to the associated high voltage lead). Worn-off particles from the contact element 4 and the electrode arrays during operation are substantially captured in the space between the two electrode arrays. Because the electric field is very weak at this area, such particles do not influence the high voltage strength of the device.

The highest field strengths occur at the area of the sides of the electrode arrangements where the vertical surfaces of the electrode arrangement meet the horizontal surfaces. However, the high field stengths occur only on the outer surfaces which are enclosed on all sides by the insulator body which may consist of, for example, epoxy resin and which has a substantially higher breakdown strength than air. Even though these field strengths can be reduced by shaping the two screens 16 and 26 of the electrode arrangements so as to have a semicircular cross-section, this is not necessary because the breakdown strength of the insulator body material is sufficiently high.

It is even more attractive to increase the vertical surfaces of the screens 16 and 26 while keeping the dimensions at the area of the separation between the two electrode arrangements the same, so that the U-shape of the cross-sections of the electrode arrangements comprises a bulging widened portion with preferably rounded corners at the area of the base line. The electric field strength in the insulator is even higher in this embodiment than in the electrode arrangement shown in FIG. 2. However, the potential distribution is changed so that the electric field strength decreases in the clearance between the insulator bodies outside the cage formed by the electrode arrangement.

However, when the insulator bodies 11 and 21 are shaped as shown in the figures (for example with closely adjoining parallel sections 14 and 24 having a length of 5 mm and a spacing of approximately 1 mm, and tapered sections 15 and 25 having an angle of inclination of approximately 21°), a potential distribution is obtained (during operation with a high voltage of 100 kV) in which the electric field strength in the gap between the insulator bodies does not ionize the air in any location. The electric field strength in the air gap between the insulators decreases in the outward direction, that is to say upward and downward in FIG. 2. It disappears almost completely at the areas of the high voltage transfer device which are accessible from the outside.

Figure 1:
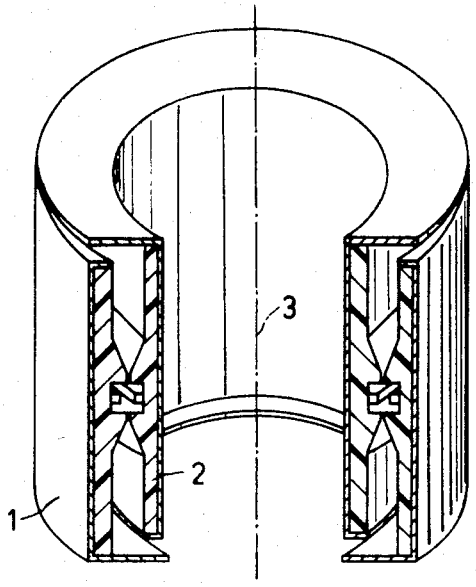
FIG. 1 is a cross-section view of a device according to the invention.

Usually a high voltage appliance is not connected to ground on one side, but operates between positive and negative high voltage potential. For the transfer of two high voltage potentials, two high voltage transfer devices of the kind shown in FIGS. 1 and 2 are required. These devices can be arranged either adjacently (in FIG. 2 one over the other) with respect to the axis of rotation 3 or concentrically with respect to one another.

For powering an X-ray tube, at least two different negative high voltage potentials must be transferred in order to enable the cathode filament of the X-ray tube to produce a current. Because the cathode potentials deviate only very little from one another, a single device as shown in FIG. 2 suffices for transferring the different cathode potentials. Then, inside the screens 16 and 26 (whose dimensions must then be increased accordingly in the vertical direction) several electrode tracks are arranged so as to be staggered in the vertical direction and electrically insulated from one another.

It follows from FIG. 1 that the axis of rotation of the device shown in FIG. 2 extends vertically and at a distance from the high voltage transfer device. One annular electrode arrangement (for example, 26 and 27) is then enclosed by the other electrode arrangement 16 and 17.

However, the described device can alternatively be used when the ring 1 and 2 are rotated about a horizontal axis of rotation above or underneath the device. With respect to the axis of rotation the electrode arrangements are then arranged adjacently in parallel. In that case the construction shown in FIG. 2 should be modified so that one of the two grounded screens 12 or 22 concentrically encloses the other screen. The axis of rotation may in general occupy any inclined position in the plane of the drawing with respect to the cross-section shown in FIG. 2, although a modification of the shape of the grounded screens 12 and 22 will be required in any case.

What is claimed is:

1. A device for transferring high voltage between two parts which are rotatable with respect to each other, said device comprising:

a first insulator body arranged around an axis of rotation;

a first electrode arrangement partially embedded in the first insulator body so as to be concentric with the axis of rotation;

a second insulator body arranged around the axis of rotation to be rotatable with respect to the first insulator body; and a second electrode arrangement partially embedded in the second insulator body so as to be concentric with the axis of rotation;

characterized in that the second electrode arrangement comprises a screen having a U-shaped cross-section in a plane which includes the axis of rotation, said U-shaped cross-section opening toward the first electrode arrangement, the second electrode arrangement extending to within such a small distance of the first electrode arrangement that the two electrode arrangements bound an annular cavity which is substantially free of electric fields.

2. A device as claimed in claim 1, characterized in that the insulator bodies are arranged to extend to within such a small distance of each other that they substantially completely enclose the electrode arrangements.

3. A device as claimed in claim 2, characterized in that:

the first electrode arrangement comprises a screen having a U-shaped cross-section in a plane which includes the axis of rotation, said U-shaped cross-section opening toward the second electrode arrangement;

each electrode arrangement further comprises a track arranged in the screen thereof so that both tracks are arranged within the annular cavity bounded by the screens; and the device further comprises a roller arranged in the annular cavity to roll on and to contact each track to form an electrical connection between the tracks.

4. A device as claimed in claim 3, characterized in that the insulator bodies comprise:

first portions which are arranged parallel to the axis of rotation and which are arranged to extend to within such a small distance of each other that they substantially completely enclose the electrode arrangements; and second portions which adjoin the first portions and which taper away from each other.

5. A device as claimed in claim 1, characterized in that the insulator bodies comprise:

first portions which are arranged parallel to the axis of rotation and which are arranged to extend to within such a small distance of each other that they substantially completely enclose the electrode arrangements; and second portions which adjoin the first portions and which taper away from each other.

6. A device as claimed in claim 1, characterized in that:

the first electrode arrangement comprises a screen having a U-shaped cross-section in a plane which includes the axis of rotation, said U-shaped cross-section opening toward the second electrode arrangement;

each electrode arrangement further comprises a track arranged in the screen thereof so that both tracks are arranged within the annular cavity bounded by the screens; and the device further comprises a roller arranged in the annular cavity to roll on and to contact each track to form an electrical connection between the tracks.

* * * * *